United States Patent [19]

Hjertstrand et al.

[11] 4,145,895

[45] Mar. 27, 1979

[54] APPARATUS FOR STORING GOODS AT STABLE TEMPERATURES IN A HEAT-INSULATED CONTAINER

[76] Inventors: Åke W. Hjertstrand, Engelbrektsgatan 12, S-11432 Stockholm; Agne B. Wedin, Box 403, S-172 04 Sundbyberg, both of Sweden

[21] Appl. No.: 757,331

[22] Filed: Jan. 6, 1977

[51] Int. Cl.[2] ..... F25D 3/10

[52] U.S. Cl. ..... 62/529; 62/438; 62/457; 252/70

[58] Field of Search ..... 252/70; 62/4, 371, 437, 62/529, 530, 457

[56] References Cited

U.S. PATENT DOCUMENTS

| | | | |
|---|---|---|---|
| 2,515,840 | 7/1950 | Rodeck | 62/4 |
| 2,677,243 | 5/1954 | Telkes | 62/4 |
| 2,677,664 | 5/1954 | Telkes | 62/4 |
| 2,989,856 | 6/1961 | Telkes | 62/438 |
| 3,236,206 | 2/1966 | Willinger | 62/60 |
| 3,273,354 | 9/1966 | Gibson | 62/457 |
| 3,802,220 | 4/1974 | Pompo | 62/457 |
| 3,810,367 | 5/1974 | Peterson | 62/457 |
| 3,970,068 | 7/1976 | Sato | 62/4 |

*Primary Examiner*—Ronald C. Capossela

*Attorney, Agent, or Firm*—Roylance, Abrams, Berdo & Farley

[57] ABSTRACT

A storage container for storing goods which are highly sensitive to deviations in temperature comprises at least two detachable sections made of a heat-insulating material. Each section is recessed so that when the sections are brought together a space is defined for receiving a storage box. Arranged in heat-conducting contact with at least one wall of the box is a thermo-block containing a substance selected from the group deuterium oxide, undecyl cyanide, 4 bromo-decanoic acid and 2 bromo-decanoic acid.

One advantage afforded by such a container is that goods, such as whole bloods, sensitive to temperature changes can be transported between regions of radically differing temperature without detriment.

20 Claims, 4 Drawing Figures

APPARATUS FOR STORING GOODS AT STABLE TEMPERATURES IN A HEAT-INSULATED CONTAINER

The present invention relates to apparatus for storing goods which are highly sensitive to deviations from a specific given temperature, and more particularly although not exclusively to such apparatus in which one or more thermo blocks, i.e. a container containing a single chemical substance having a suitable, well-defined melting point is or are arranged in thermal-conductive connection with a closed container having a high thermal conductivity the goods prior to being stored being brought to a temperature within the tolerable temperature limits for the goods, while the thermo block is brought to a temperature which deviates from the tolerance temperature in the other direction, towards an expected ambient temperature.

Such an apparatus is capable of storing whole blood or component thereof at temperatures between 1° C. and 6° C. at ambient temperatures lying above or below this temperature range.

It is previously known to store goods which are sensitive to temperature in thermally insulated containers in which so-called cooling blocks are housed. One simple example of such a container is that used by housewives to store food. In this case, the interior of the thermal container need only be kept cool for a relatively short period of time. Because of this, and because direct contact of the food with the cooling block is not normally harmful, it suffices to freeze the block to the necessary temperature prior to using the same. The block can be chilled to the required temperature in a domestic refrigerator for example.

In their simplest form, the cooling blocks are filled solely with water, which when frozen has a high heat of fusion and consequently is able to maintain the food in a cool environment for a considerably period of time. Such an apparatus is effective to keep food wholesome or to keep beverages cool for a certain period of time at ambient temperatures which lie above the desired storage temperatures.

In the case, however, of the storage or transportation of blood, blood components and many other substances, both living and dead, for example certain organisms, vaccine, serum, bacteriological and biological substances, enzymes, pharmacological substances, electronic components, films and chemical substances measures must be taken to ensure that the object to be stored (hereinafter referred to as the goods) can be constantly kept within a predetermined specific temperature range, often at extremely close tolerances. Blood, by which is meant predominantly transfusion blood, must be maintained within a close temperature range of between +1° and +6° C. during its passage between donor and receiver. The aforementioned apparatus using cooling blocks filled with water cannot be considered for the storage of blood within tolerable temperature ranges, particularly in the case when the ambient temperature falls beneath the committed storage temperature, since the latent heat of fusion of water on the formation of ice is not released until the temperature falls below 0° C.; moreover super-cooling phenomena readily occur.

A further temperature-stable apparatus for storing and transporting goods which are sensitive to temperature is described in U.S. Pat. No. 2,989,856. The apparatus comprises a heat-insulated container in which space is provided for the goods to be stored and for heat-absorbing and heat-emitting substances enclosed in thermo blocks which are placed in layers against two mutually opposing walls. According to the Patent Specification, a desired temperature of 4.4° C. (40° F.) can be achieved with thermo blocks containing a mixture of the salts sodium chloride and potassium chloride and the salt hydrated sodium sulphate ($Na_2SO_4$, $10H_2O$).

In practice, however, it has been found that such an apparatus and the mixtures (eutectic) suggested for stabilising the temperature thereof, are not capable of effectively storing temperature-sensitive goods for long periods, nor of maintaining the stored goods at the necessary temperature. It has been found in practice that considerable temperature gradients occur within the stored goods after some time has elapsed, and that the stabilising control medium does not prevent the temperature of the stored goods from passing beyond the given tolerance limits within an acceptable period of time.

Blood banks have been established to ensure that blood given to a patient is qualitatively of a high grade. Blood banks and similar establishments normally have unlimited access to electrical energy, highly efficient temperature-control storage spaces and control equipment thereby enabling blood to be stored quite safely. Great difficulties are encountered, however, in transferring blood from blood banks to places remote therefrom since blood is destroyed if its temperature falls beneath +1° C., and is rapidly impaired when its temperature rises above +6° C.

The problems encountered when transporting individual containers which lack any form of energy source and control instruments to remote hospitals, field hospitals and other places where blood transfusions may be necessary, presents a difficultly solved problem, particularly as the ambient temperature may vary radically during transport. These problems cannot be solved with the aforementioned cooling block containing water, the freezing point of which is ±0° C. Neither can the problem be solved with the apparatus disclosed in the aforementioned U.S. Patent specification, since this apparatus will not ensure that the temperature of the blood stored therein remains stable and will not enable the blood to be stored unimpaired for the requisite period of time.

To reduce the risk of blood being destroyed by excessive chilling and to enable it to be stored within the requisite temperature range, it has been proposed to fill the cooling blocks with salt solutions whose solidification points are more suitable with respect to the temperature range in question. In this case the heat of fusion has been utilised to prevent overheating of the blood. Although these thermo-blocks have been found satisfactory under certain conditions, they have not been efficient in the long-term storage of goods in widely varying climatic conditions. Moreover, they are incapable of maintaining an environment of constant temperature within specific limits. Eutectic mixtures will not always melt and solidify at an exact solidification temperature, but will, in practice, melt and solidify at temperatures outside those at which blood can safely be stored.

An object of the invention is to provide an improved storage container in which the occurrence of temperature gradients in the stored goods is inhibited.

According to another aspect the invention consists in a storage container comprising at least two detachable sections each of which is made of a heat-insulating material and each of which is recessed such that when the two sections are brought together a space is formed within said container, a storage box made of a heat-conductive material accommodated in said space, and a thermo-block having a high heat-conductivity and arranged in heat-conducting contact with at least one wall of said box, said thermo-block having the form of a sealable vessel containing a substance selected from the group deuterium oxide, undecyl cyanide, 4-bromodecanoic acid and 2-bromo-decanoic acid.

The invention will now be described in more detail with reference to embodiments thereof shown in the accompanying schematic drawings, in which.

Figure 1:
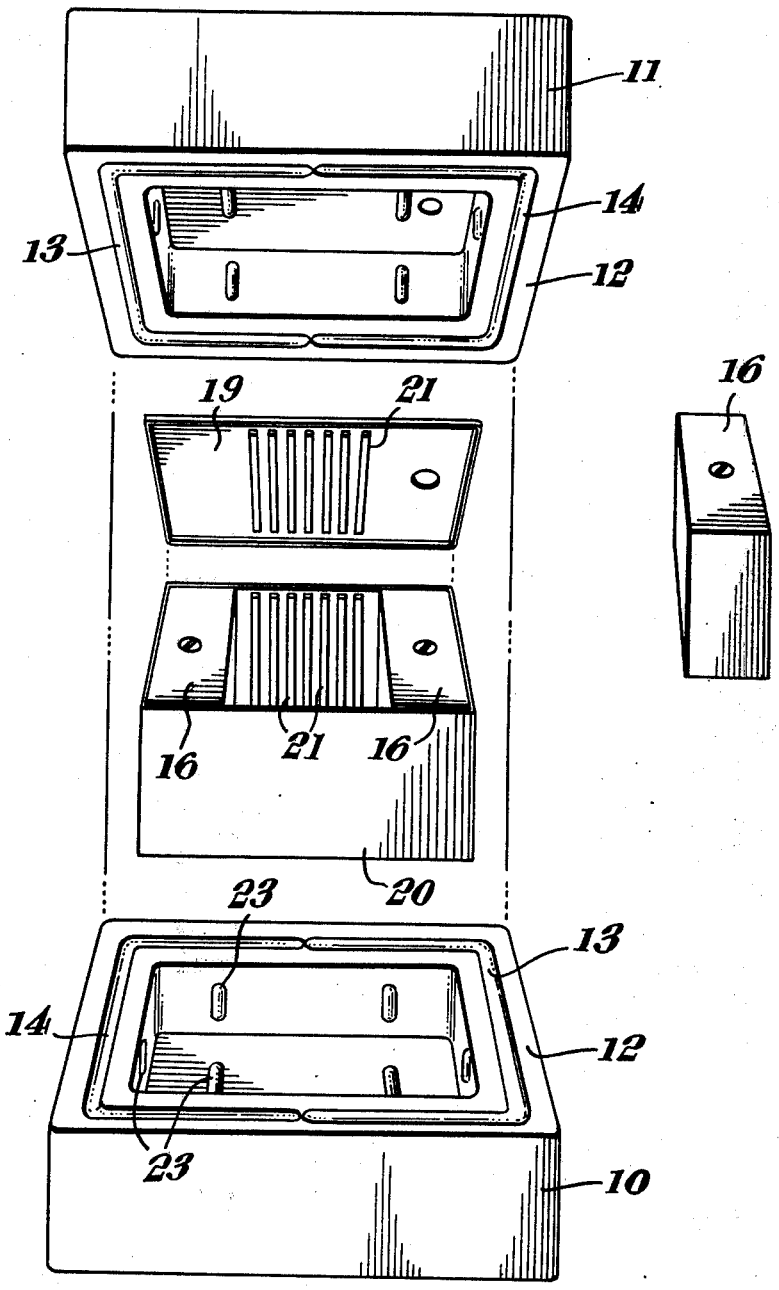
FIG. 1 is an exploded view of a storage and transport apparatus having an insert box according to the invention, the various component of the apparatus being separated from one another and shown in perspective.

The illustrated apparatus for storing and transporting temperature-sensitive goods comprises a container made of a heat-insulating material and having two parts 10, 11 which, in the illustrated embodiment, are of identical construction and thus exchangeable. The two parts 10, 11 are so constructed that when placed one on top of the other there is formed therein a closed, well heat-insulated space 15 in which temperature-sensitive goods can be stored and in which an insert box according to the invention containing two thermo-blocks 16 can be placed for stabilising the temperature in the space 15.

Each thermo-block 16 has the form of a container provided with a heat-absorbing and/or heat-emitting medium, the nature of which depends upon the desired storage temperature of the apparatus. The thermo-block comprises material having good thermal conductivity such as aluminium, and is provided with a filling hole 17 which can be sealingly closed with a plug 18. The stored goods must not in any way be affected by the medium in the thermo-block 16, and consequently the block should be so constructed and, subsequent to being filled, so carefully sealed that no contact can take place between the medium and said goods. In practice it has been found that the temperature of goods stored in such an apparatus can be maintained approximately constant over a certain period of time. When deviations in the temperature of different portions of the goods from a specified temperature cannot be tolerated, however, and when the goods are to be stored over long periods of time, such as several days in extreme weather conditions, such an apparatus is not fully efficient. As a result of varying degrees of heat flow to and from the surroundings and from and to different parts of the storage space between the thermal blocks and the stored goods, a temperature difference between different portions of the goods can readily occur. By providing the heat-insulating container 10, 11 with an insert box 20 it is possible to improve conditions in several respects. The insert box is manufactured from a heat-conductive material such as aluminium or copper, and is provided with a closable lid 19. As will be readily perceived, local heat flows from without or within the box will not initially cause any appreciable change in temperature of the box, but that the heat flow, as a result of the high coefficient of thermal conductivity of the box will be distributed throughout the box walls. The thermo-blocks 16 have planar surfaces which extend at right angles to each other and whose dimensions relative to the dimensions of the insert box 20 are such that the thermo-blocks are in heat-conducting contact with said box on all sides thereof except one, this excepted side being the one which faces the stored goods. In this way, any local change in the temperature of the insert box will be primarily taken up and equalised by the thermo-block, and the stored goods will not be affected by such temperature changes until the total heat capacity of the blocks has been exhausted.

The lid 19 of the box 20 sealingly closes the opening of said box, thereby preventing a fall in temperature within the box when the air content thereof is saturated with vapours resulting from evaporation of the stored goods.

Conveniently the outer surfaces of box 20 are polished or provided with heat-reflecting layers so as to reflect heat radiation to the greatest possible extent.

For the purpose of reducing heat flow from and to the stored goods and to and from the walls of the insert box the inner walls of the box and the inner surface of the lid 19 are provided with strips of material having a low coefficient of heat-conductivity such as cork or foam plastics, thereby to prevent direct heat-conducting contact of said walls and lid with the stored goods. The strips are either continuous or in the form of axially spaced sections, and the strips on the vertically extending sides of the box extend parallel to one another to form air gaps therebetween, the air in the gaps forming an insulating layer. The strips also permit limited convention, which assists in equalising local temperature gradients between different parts of the box walls. In a corresponding manner, the sides of the thermo-blocks 16 facing the stored goods are provided with strips 21 (FIG. 2) which define air gaps therebetween. The occurrence of temperature gradients can be further reduced by giving the insert box 20 slightly smaller dimension that the space 15 in the heat-insulated container so as to form a gap around the box on all sides thereof. Such a gap is referenced 22 in FIG. 2. The width of this air gap is preferably between 5 and 15 mm, thereby bringing heat transfer to or from the box 20 to a minimum. The insert box 20 is held in a predetermined position in the container 10, 11 by means of a multiplicity of spacers 23 arranged on the lid, base and sides of the container. In the illustrated embodiment, the spacers 23 are formed in the heat-insulated container. The spacers 23 between the insert box 20 and the container 10, 11 are made of such a material and have such form that heat transmission by conduction is effectively reduced. Preferably, the spacers 23 are in substantially line contact with the box 20, so as to occupy as little as possible of the air gap 22 around the box.

Figure 2:
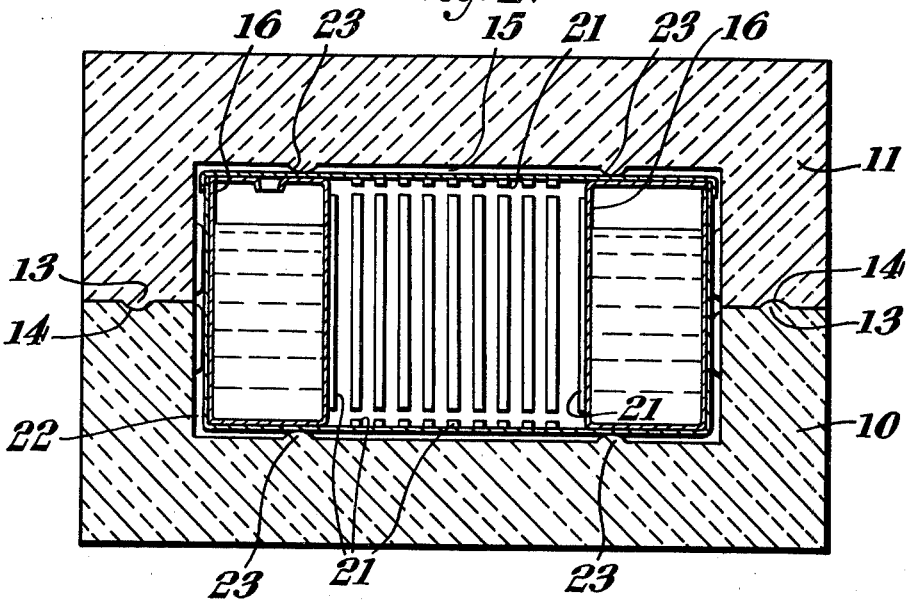
FIG. 2 is a vertical sectional view of the apparatus shown in FIG. 1 with the components of the apparatus shown in their in-use position.

The heat insulated container 10, 11 is suitably made of foamed polyurethane, conveniently containing a heavy gas, or of some other material having a very low coefficient of thermal conductivity. In FIG. 2 the insert box 20 is constructed to receive two thermo-blocks 16 such that a parallelepipedic space is defined between opposing walls of the thermo-blocks and the box 20. Alternatively, the insert box 20 may be constructed to accommodate only the goods to be stored, in which case the thermo-blocks are arranged externally of the insert box in heat-conducting contact with two opossing sides thereof.

Conveniently the outer and inner surface of the container 10 11 are resistant to wear and impact. This can be achieved, for example by integrally foaming the material forming the insulation. Further, the container should be constructed in a manner such that the parts 10 and 11 are diffusion free.

As before mentioned, blood and blood components must be maintained at a temperature lying between 1° C. and 6° C. when transported. To this end, the thermo-blocks are filled with a heat-absorbing and heat-emitting, temperature-stabilising medium. Examples of such a medium include deuterium oxide, undecyl cyanide, 4-bromo decanoic acid and 2-bromo decanoic acid. These substances are homogenous, chemical substances which have a more clearly defined solidification temperature/melting temperature than previously known control substances for storage devices. The temperature-stabilising substances proposed in the aforementioned U.S. Patent specification comprise eutetics, i.e. different types of salt solutions. The temperature-stabilising substances according to the invention have solidification and melting points which lie very close to 4° C., which is what is required for storing transfusorial blood within the permitted temperature range of 1° C. to 6° C. The substances can also be stored for long periods without decomposing and can be safely handled without requiring particular protective equipment.

Despite the fact that the aforementioned substances according to the invention exhibit good properties for the intended purpose, they have a relatively low heat conductivity. As a result hereof, temperature gradients may occur within the stored substance in the thermo-block thereby rendering heat exchange between the substance and the goods difficult. The risk of such temperature gradients is eliminated according to the invention by placing within the thermo-block a heat-conducting, suitably metallic member in the form of corrugated plates 24. Alternatively the thermo-blocks may be provided with flanges, metal wire net or inserts in the form of lattice structures for the same purpose. These inserts or members can be freestanding or may be connected either wholly or partially to the walls of thermo-block in intimate heat conducting contact therewith.

Figure 3:
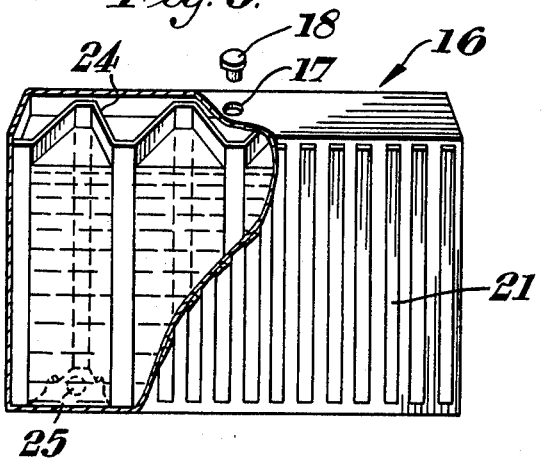
FIG. 3 is a view in perspective of a temperature-stablising thermo-block with part of the block being cutaway for the purpose of illustration.

It has been found in practice that with a thermo-block filled with one of the aforementioned chemical substances, a super-cooling phenomenon occurs in cold environments. The release of the latent heat of solidification is delayed with such super cooling, with the result that the temperature of some parts of the stored goods can fall below the permitted storage temperature. In order that the heat of solidification can be utilised in an early stage of the super cooling process, so as to maintain the temperature of the store of goods within the requisite temperature range, the thermo-blocks 16 shown in FIG. 3 have been provided with a solidification-initiating means 25. The sub-microscopic crystals which occur randomly during the super-cooling process obtain an addition of energy through the solidification initiating means, this energy addition increasing the thermal movement of the crystals so that they approach each other in a manner such that a sufficiently large crystal is formed to permit further growth.

One example of a suitable solidification-initiating means is a radio active preparation, such as polonium, enclosed in a suitable casing.

A further example of such an initiating means is a temperature-control bimetal element which, at a predetermined temperature, adopts such a position that a stirrup spring or double bent plate spring causes a tongue-like element to strike a contact surface, the impact causing the substance to solidify before the super-cooling process has proceeded too far. Such a temperature-controlled element operates in the manner of a microswitch.

To avoid any disadvantage associated with the use of a radio active substance or a device relying upon mechanical movement, with the possible risk of ageing phenomena, the thermo-block may be provided with a device utilising the transportation of heat to form what can be termed a seed crystal, which crystal instigates further crystallisation of the substance. The advantage afforded by such a seed crystal is that it can be formed before the temperature of the thermo-block or the stored goods has dropped to an unsuitably low level before stabilisation of the temperature to magnitudes within the desired temperature range is obtained.

Figure 4:
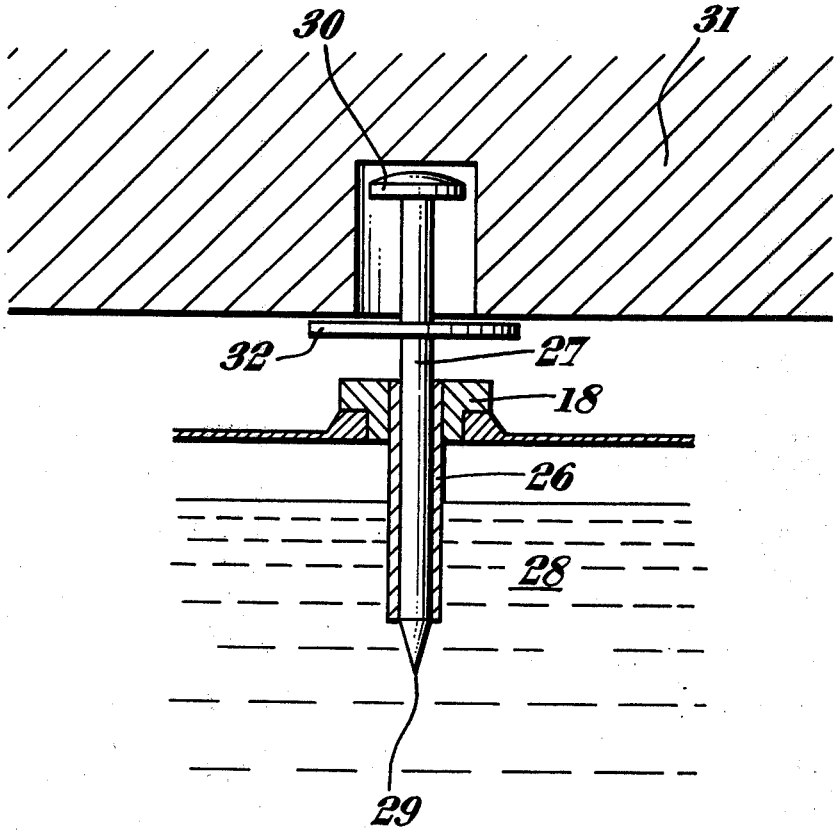

A seed-crystal producing device is shown in FIG. 4. In the illustrated embodiment, the sealing plug 18 is provided with a through-passing bore through which a tubular sleeve 26 of a material of relatively low heat conductivity extends. Extending through the sleeve 26 is a pin 27, said pin being arranged in the sleeve such that only the tip 29 thereof is in direct contact with the control substance 28. In the illustrated embodiment the pin 27 is extended upwardly through the wall of the thermo block housing the plug 18 and beyond said plug into a recess formed in the container wall adjacent said pin in the closed position of the container. Although the pin is shown to have a head 30 and a collar 32, which sealingly abuts said wall, here referenced 31, it will be understood that the provision of said head and collar is an optional feature. The pin 27 comprises a material of high thermal conductivity, such as aluminium. Assuming a drop in ambient temperature to −25° C., the temperature within the recess will fall to about −8° C., and consequently the temperature prevailing at the tip 29 will change accordingly, thereby causing the growth of a seed crystal at said tip. Alternatively the end of the pin remote from said tip can be extended into contact with a surface of said wall. The heat-insulating casing 31, which is a prerequisite for the use of the temperature-stabilising properties of the thermo block within the storage space, causes in the case of a cold environment, the front of the temperature gradient to migrate slowly inwardly through the casing, whereafter a marked gradient remains in the continuity state. Consequently in the part located in the insulated casing 31 the pin 27 is subjected to a substantially lower temperature than that prevailing in the substance 28, whereupon, as a result of the thermal conductivity of the pin and the low thermal conductivity of the sleeve 26 and the substance 28 a seed crystal is formed at the point 29 of the pin 27 in good time.

What we claim is:

1. A thermo-block for use in maintaining the temperature of stored goods within a temperature range of 1°–6° C., wherein said thermo-block comprises a sealable container containing a substance taken from the group consisting of deuterium oxide, undecyl cyanide, 4-bromo-decanoic acid and 2-bromo-decanoic acid.

2. A thermo-block as claimed in claim 1, wherein the interior of said container is provided with heat-conductive means serving to enlarge the effective surface area of said interior.

3. A thermo-block as claimed in claim 2, wherein said heat-conductive means are in direct contact with the walls of said container.

4. A thermo-block according to claim 1 wherein said thermoblock further comprises crystallization inducing means effective to prohibit super-cooling of said substance.

5. A thermo-block as claimed in claim 4, wherein the crystallization inducing means comprises a pin having a relatively high heat-conductivity extending through a sleeve having a relatively low heat conductivity said pin and said sleeve extending sealingly through one wall of said container, and wherein one end of said pin protrudes from said sleeve so as to be in direct contact with said substance, and the other end of said pin extends beyond said one wall for contact with a heat-insulated surface.

6. A thermo-block according to claim 1 wherein said thermoblock is provided on one side thereof with spacing elements having a low heat-conductivity.

7. A thermo-block as claimed in claim 6, wherein each said spacing element has the form of a continuous coherent strip.

8. A thermo-block as claimed in claim 6, wherein each spacer element has the form of axially spaced strip sections.

9. A storage container comprising at least two detachable sections each of which is made of a heat-insulating material and each of which is recessed such that when the two sections are brought together a space is formed within said container, a storage box made of a heat-conductive material accommodated in said space, and a thermo-block having a high heat-conductivity and arranged in heat-conducting contact with one wall of said box, said thermo-block comprising a sealable vessel containing a substance selected from the group consisting of deuterium oxide, undecyl cyanide, 4-bromo-decanoic acid and 2-bromo-decanoic acid.

10. A container as claimed in claim 9, wherein the interior of said vessel is provided with heat-conductive means serving to enlarge the effective surface area of said interior.

11. A container as claimed in claim 10, wherein said heat-conductive means are in direct contact with the walls of said vessel.

12. A container as claimed in claim 9, wherein said thermo-block further comprises crystallization inducing means effective to prohibit super-cooling of said substance.

13. A container as claimed in claim 12, wherein the crystallization inducing means comprises a pin having a relatively high heat-conductivity extending through a sleeve having a relatively low heat conductivity said pin and said sleeve extending sealingly through one wall of said thermoblock, and wherein one end of said pin protrudes from said sleeve so as to be in direct contact with said substance, and the other end of said pin extends beyond said one wall and into a cavity formed in the wall of the storage-container adjacent thereto in the closed position of said section or into engagement with said wall.

14. A container as claimed in claim 9, wherein means are provided for holding the box in a determined position in said space.

15. A container as claimed in claim 9, wherein the inwardly facing surfaces of at least two mutually opposite walls of the storage box are provided with strips of material of low heat-conductivity, said strips defining therebetween insulating air gaps.

16. A container as claimed in claim 15, wherein said strips are made of cork.

17. A container as claimed in claim 15, wherein said strips are made of foamed polyurethane.

18. A container as claimed in claim 15, in which the thermo-block is arranged within the storage box so all sides of said block except one are in contact with cooperating sides of the box, wherein said one side is provided with strips of material of low heat-conductivity defining insulating air gaps therebetween.

19. A container as claimed in claim 1, in which the storage box is smaller than said space, whereby a heat insulating gap is formed around said box.

20. A container as claimed in claim 19, wherein said gap is from 5–15 mm in width.

* * * * *